US010914560B2

(12) United States Patent
Masinelli et al.

(10) Patent No.: US 10,914,560 B2
(45) Date of Patent: Feb. 9, 2021

(54) HOLLOW POINT BULLET

(71) Applicant: Olin Corporation, St. Louis, MO (US)

(72) Inventors: Kyle A. Masinelli, Oxford, MS (US); Charles Willis Moore, Oxford, MS (US)

(73) Assignee: OLIN CORPORATION, St. Louis, MO (US)

( * ) Notice: Subject to any disclaimer, the term of this patent is extended or adjusted under 35 U.S.C. 154(b) by 0 days.

(21) Appl. No.: 16/661,311

(22) Filed: Oct. 23, 2019

(65) Prior Publication Data

US 2020/0182596 A1 Jun. 11, 2020

Related U.S. Application Data

(60) Provisional application No. 62/752,612, filed on Oct. 30, 2018.

(51) Int. Cl.
*F42B 12/34* (2006.01)
*F42B 12/74* (2006.01)

(52) U.S. Cl.
CPC ..... *F42B 12/34* (2013.01); *F42B 12/74* (2013.01)

(58) Field of Classification Search
CPC ..... F42B 12/34; F42B 12/74
See application file for complete search history.

(56) References Cited

U.S. PATENT DOCUMENTS 1,023,469 A * 4/1912 Haslett ..... F42B 12/34 102/510
1,134,797 A * 4/1915 Wood ..... F42B 12/34 102/508
1,141,212 A * 6/1915 Ross ..... F42B 12/34 102/509
1,155,901 A * 10/1915 Duncan ..... F42B 12/34 102/508
3,311,962 A * 4/1967 Burns, Jr. ..... F42B 12/78 86/55
3,720,170 A * 3/1973 Godfrey ..... F42B 12/78 102/516
3,991,684 A * 11/1976 Pritchard ..... F42B 12/34 102/510
4,016,817 A * 4/1977 Arciniega Blanco ..... F42B 7/10 102/519
4,136,616 A * 1/1979 Schirneker ..... F42B 12/34 102/510
4,175,492 A * 11/1979 Knappworst ..... F42B 12/34 102/503
4,245,557 A * 1/1981 Knappworst ..... F42B 12/34 102/508
4,665,827 A * 5/1987 Ellis, II ..... F42B 12/34 102/510

(Continued)

*Primary Examiner* — Michelle Clement
(74) *Attorney, Agent, or Firm* — Harness, Dickey & Pierce, P.L.C.

(57) ABSTRACT

An improved hollow point bullet has a core of a soft, dense metal having a generally cylindrical rear section, a tapering front section, and an open forward end opening to a cavity. A jacket of a harder metal than the core surrounds at least the rear and front sections of the core, and extends at least partially into the cavity. An expander of a rigid polymer is disposed in the cavity, substantially filling the cavity and providing at least one passage through to the bottom of the cavity.

15 Claims, 2 Drawing Sheets

(56) References Cited

U.S. PATENT DOCUMENTS 4,704,968 A * 11/1987 Davis, Jr. ..... F42B 12/34 102/507
4,776,279 A * 10/1988 Pejsa ..... F42B 12/34 102/510
4,777,883 A * 10/1988 Chevich ..... F42B 10/34 102/503
6,016,754 A * 1/2000 Enlow ..... F42B 12/74 102/516
6,349,651 B1 * 2/2002 Martinez Garcia ..... F42B 7/10 102/501
6,405,654 B1 * 6/2002 Smith ..... F42B 12/34 102/501
6,675,718 B1 * 1/2004 Parker ..... F42B 12/34 102/507
7,966,937 B1 * 6/2011 Jackson ..... F42B 12/74 102/517
10,641,591 B1 * 5/2020 Rubin ..... F42B 12/54
2003/0089264 A1 * 5/2003 Eberhart ..... F42B 12/74 102/510
2003/0106453 A1 * 6/2003 Garcia ..... F42B 14/064 102/521
2003/0167954 A1 * 9/2003 Baumgartner ..... F42B 12/34 102/510
2003/0209164 A1 * 11/2003 Pi ..... F42B 12/34 102/510
2004/0003747 A1 * 1/2004 Hietanen ..... F42B 12/34 102/510
2004/0244629 A1 * 12/2004 Jopson ..... F42B 12/367 102/508
2005/0034626 A1 * 2/2005 Sanborn ..... F42B 12/34 102/510
2005/0126422 A1 * 6/2005 Lamm ..... F42B 8/12 102/518
2005/0241523 A1 * 11/2005 Schikora ..... F42B 12/34 102/510
2005/0241524 A1 * 11/2005 Garcia ..... F42B 7/08 102/521
2006/0144280 A1 * 7/2006 Hirt ..... F42B 12/34 102/509
2008/0092768 A1 * 4/2008 Krstic ..... F42B 12/74 102/522
2010/0224093 A1 * 9/2010 Wilhelm ..... F42B 12/74 102/507
2012/0272855 A1 * 11/2012 Rebar ..... F42B 12/34 102/517
2012/0291655 A1 * 11/2012 Jones ..... F42B 10/26 102/502
2013/0199395 A1 * 8/2013 Frew ..... F42B 12/204 102/481
2014/0202351 A1 * 7/2014 Muskat ..... F42B 12/02 102/514
2014/0318406 A1 * 10/2014 Rall ..... F42B 33/001 102/510
2014/0326158 A1 * 11/2014 Fritz ..... F42B 30/02 102/524
2015/0018143 A1 * 1/2015 Chia ..... F42B 6/003 473/582
2015/0018144 A1 * 1/2015 Chia ..... F42B 12/34 473/582
2015/0020705 A1 * 1/2015 Hartmann ..... A62C 3/025 102/369
2015/0083011 A1 * 3/2015 Emary ..... F42B 12/34 102/506
2015/0354930 A1 * 12/2015 Fricke ..... F42B 12/34 102/439
2016/0169645 A1 * 6/2016 Emary ..... F42B 12/34 102/439
2016/0265889 A1 * 9/2016 Golloher ..... F42B 12/34
2016/0298947 A1 * 10/2016 Rubin ..... F42B 12/54
2016/0313100 A1 * 10/2016 Balzano ..... F42B 12/34
2017/0089673 A1 * 3/2017 Burrow ..... F42B 12/32
2017/0138712 A1 * 5/2017 Teig ..... F42B 33/00
2017/0234664 A1 * 8/2017 Golloher ..... F42B 12/34 102/510
2017/0248396 A1 * 8/2017 Riess ..... F42B 12/34
2017/0261294 A1 * 9/2017 Riess ..... F42B 12/36
2018/0094911 A1 * 4/2018 Fournier ..... F42B 12/74
2018/0106581 A1 * 4/2018 Rogers ..... F42B 33/001
2018/0224249 A1 * 8/2018 Carbone ..... F42B 10/44
2018/0321021 A1 * 11/2018 Teig ..... F42B 10/32
2018/0321023 A1 * 11/2018 Teig ..... F42B 12/06
2019/0017789 A1 * 1/2019 Burczynski ..... F42B 30/02
2019/0113320 A1 * 4/2019 Folaron ..... F42B 12/06
2019/0277610 A1 * 9/2019 Eberhart ..... B22D 17/2263
2019/0316888 A1 * 10/2019 Thielen ..... F42B 12/78
2020/0182596 A1 * 6/2020 Masinelli ..... F42B 12/74
2020/0225010 A1 * 7/2020 Gershonsky ..... C01B 32/949
2020/0263963 A1 * 8/2020 Stenzel ..... F42B 12/34
2020/0284563 A1 * 9/2020 Jones ..... F42B 12/78

* cited by examiner

HOLLOW POINT BULLET

FIELD

This invention relates to hollow point bullets, and in particular to hollow point bullets with an expander element to improve the operation and reliability of the bullets.

BACKGROUND

This section provides background information related to the present disclosure which is not necessarily prior art.

Hollow point bullets have a cavity therein opening to the forward end of the bullet to facilitate the expansion of the bullet once it strikes its target. The concept of hollow point bullets is well known, and these bullets operate reliably and effectively to expand in the target, causing disabling disruption in the target. However, improvements continue, with efforts directed to improving the operation, i.e., expansion, of the bullet, and improving the reliability of the bullet, i.e. expanding only upon entry of the intended target. A particular difficulty has been to ensure that such bullets properly expand in the ultimate target after passing through intervening materials, such as cloth or glass or wallboard. For example, some hollow point bullets that first pass through a material such as wallboard before striking their ultimate target may have their cavities become plugged and either fail to expand or fail to fully expand.

SUMMARY

This section provides a general summary of the disclosure, and is not a comprehensive disclosure of its full scope or all of its features.

Embodiments of the present invention provide improved hollow point bullets. A first preferred embodiment of a bullet according to the principles of the present invention comprises a core of a soft, dense metal having a generally cylindrical rear section, and tapering front section, and an open forward end, opening to a cavity formed therein with a generally cylindrical sidewall and a bottom. A jacket of a harder metal than the core surrounds at least the rear and front sections of the core, and preferably extends at least partially into the cavity. An expander of a rigid polymer is disposed in the cavity. The expander substantially fills the cavity, but has at least one passage extending from the forward end to the rearward end.

The expander is preferably a generally cylindrical body, having a plurality of generally longitudinally extending flutes formed in its surface, defining a plurality of splines between them. The flutes and the walls of the cavity cooperate to form a plurality of passages extending from the forward end of the bullet to the bottom of the cavity. The forward and rearward ends of the expander are preferably higher in the center than adjacent the sides. In some embodiments, the ends of the expander are pointed, in other embodiments the ends of the expander are dome-shaped.

The passages in the expander comprise between about 20% and about 60% of the cross sectional area of the cavity, and more preferably between about 40% and about 60% of the cross sectional area of the cavity. The cross-sectional area of each passage is preferably less than about 0.004 $in^2$, and more preferably less than about 0.002 $in^2$.

The forward-most portion of the expander preferably does not extend beyond the forward end of the bullet. The center of mass of the bullet is preferably rearward of the bottom of the cavity.

The core is preferably lead or a lead alloy. The jacket is preferably copper or a copper alloy. The jacket is preferably bonded to the core. This can be a metallic bond, for example by forming the core in the jacket, or heating the jacket and core together. Alternatively the bond can be formed with an adhesive agent. Lastly, the jacket can be mechanically bonded to the core, for example with knurling on the jacket, that impinges the core.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
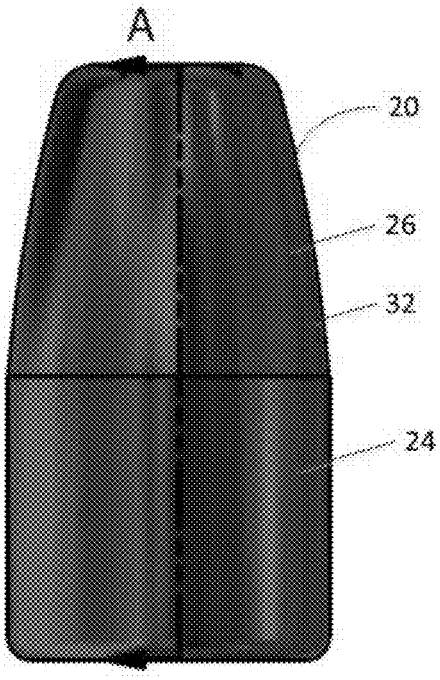
FIG. 1 is a side elevation view of a first preferred embodiment of a bullet constructed according to the principles of this invention.
Figure 2:
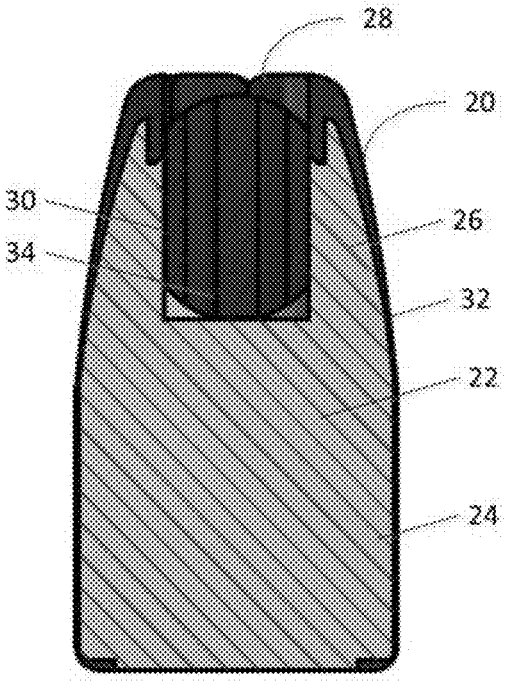
FIG. 2 is a longitudinal cross sectional view of a the bullet shown in FIG. 1.
Figure 3:
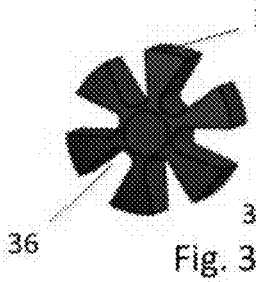
FIG. 3 is a perspective view of a section of the expander of the first preferred embodiment.

A first preferred embodiment of a bullet according to the principles of the present invention is indicated generally as 20 in FIGS. 1 and 2. The bullet 20 comprises a core 22, preferably of a soft, dense metal. The core 22 has a generally cylindrical rear section 24, a tapering front section 26, and an open forward end 28, opening to a cavity 30 formed therein. The cavity 30 has a generally cylindrical sidewall and a generally circular bottom. A jacket 32 of a harder metal than the core 22 surrounds at least the rear and front sections 24 and 26 of the core, and extends at least partially through the open forward end 28 and into the cavity 30. An expander 34 of a rigid polymer is disposed in the cavity. The expander 34 substantially fills the cavity 30, and has at least one passage 36 extending from its forward end 38 to its rearward end 40.

As shown in FIGS. 2-3 and 7-9, the expander 34 of the first preferred embodiment is preferably a generally cylindrical body 36, having a plurality of generally longitudinally extending flutes 39 formed in its exterior surface, defining a plurality of splines 40 between them, cooperating with the walls of the cavity 30 to form a plurality of passages 36 extending from the forward end 38 to the rearward end 40, effectively connecting the forward end of the bullet 20 with the bottom of the cavity. In this preferred embodiment there are six flutes 39, forming six generally wedge shaped splines 40, projecting from an axially extending hub 42. The forward and rearward ends 38 and 40 of the expander 34 are preferably higher in the center than adjacent the sides. In some embodiments, the ends of the expander 34 are pointed, in other embodiments the ends of the expander are dome-shaped, as shown in FIGS. 2-3 and 7-9.

Figure 4:
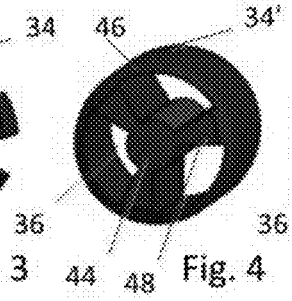
FIG. 4 is a perspective view of a section of the expander of a second preferred embodiment.
Figure 5:
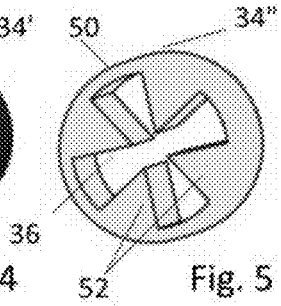
FIG. 5 is a perspective view of a section of the expander of a third preferred embodiment.
Figure 6:
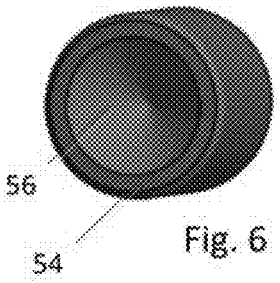
FIG. 6 is a perspective view of a section of the expander of the first preferred embodiment.
Figure 7:
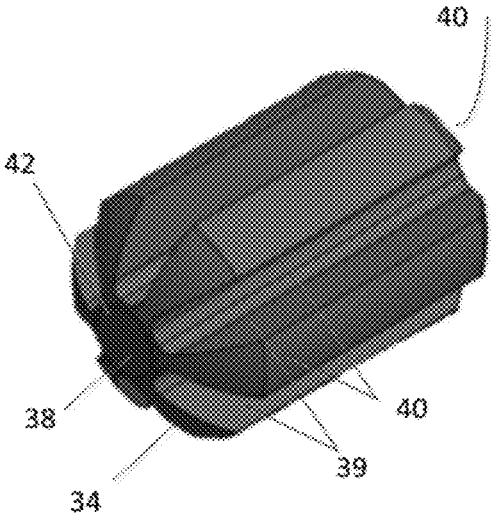
FIG. 7 is a perspective view of the expander of the first embodiment.
Figure 8:
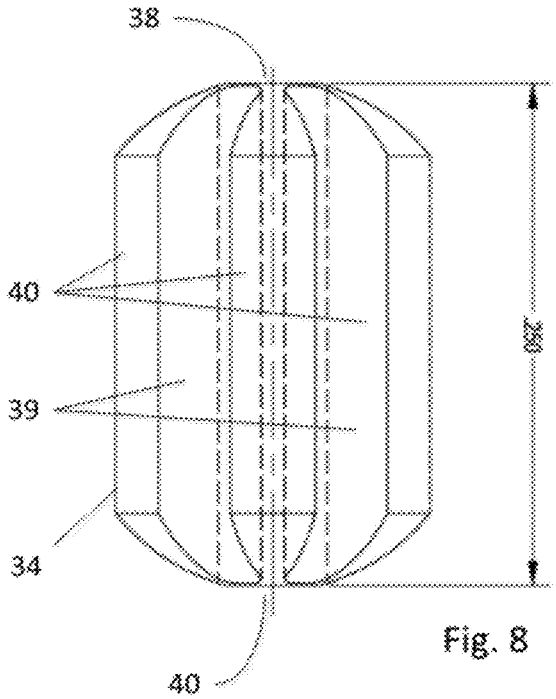
FIG. 8 is a side elevation view of the expander of the first embodiment.
Figure 9:
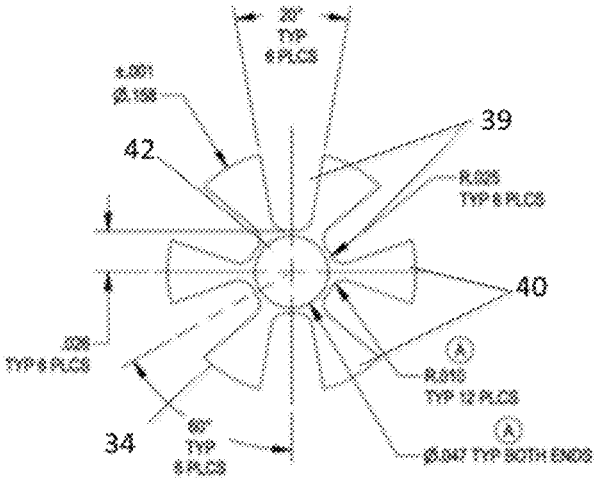
FIG. 9 is an end elevation view of the expander of the first embodiment.

Alternate embodiments of the expander 34 are indicated as 34' and 34" in FIGS. 4 and 5. As shown in FIG. 4, expander 34' includes a central hub 44 surrounded by a circumferential ring 46, with three generally radially extending splines 48 between the hub and the ring, defining three passages 36 there through. As shown in FIG. 5, expander 34" has a circumferential ring 50, with a plurality (4) inwardly extending wedge shaped members 52, defining a single passage 36 with a generally cross-shaped cross-section. The expander members 34, 34' and 34" are preferably made from a relatively rigid polymer material, such as a high impact polystyrene. FIG. 6 shows an alternate to an expander member 34, comprising a plug 54 with a forward-facing dimple 56. The plug 54 can be made of a rigid polymeric material, but alternatively could be made of a highly resilient material, such as an elastomer. While plug 54 can improve performance in certain limited conditions, it does not perform as well as the expander members 34, 34' and 34" which have passages therethrough, and in particular expander member 34 of the first preferred embodiment.

The passages 36 in the expander 34 comprise between about 30% and about 60% of the cross sectional area of the cavity 30, and more preferably between about 45% and about 60% of the cross sectional area of the cavity. It is believed that this allows sufficient passage through the expander and into the cavity to facilitate expansion of the bullet. The cross-sectional area of each passage is preferably less than about 0.004 $in^2$, and more preferably less than about 0.002 $in^2$. It is believed that this helps prevent materials from entering and clogging the passages, The forward-most end 38 of the expander 34 preferably does not extend beyond the forward end of the core 22 and jacket 32. The center of mass of the bullet 20 is preferably rearward of the bottom of the cavity 30.

The core 22 is preferably lead or a lead alloy, but could also be of a non-lead metal or metal alloy. The core 22 can be pre-formed and inserted into the jacket 32, or the core can be formed in a drawn cup that becomes the jacket. The open forward end 28 and the cavity 30 can be formed by punching the bottom of the cup, during which operation the tapering front portion 26 can be shaped as well.

The jacket 32 is preferably copper or a copper alloy but could be some other material. Lines of weakness can be formed in the forward portion of the jacket 32 (including the portion that extends at least partly into the cavity 30) to facilitate the expansion of the bullet 20. These lines of weakness can be cuts through or partially through the jacket 32, lines of perforation, or lines of reduced thickness. The jacket 32 is preferably bonded to the core 22. This bonding can be a metallic bond, for example by forming the core in the jacket (as described above), or heating the jacket 32 and core 22 together. Alternatively the bonding can be formed with an adhesive or other agent. Lastly, the jacket can be mechanically bonded to the core, for example with knurling 60 on the jacket 32, that impinges and engages the core 22.

The invention also comprises cartridges made with bullets in accordance with the principles of this invention.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A bullet comprising:

a core of a soft, dense metal, the core having a generally cylindrical rear section, a tapering front section, and an open forward end communicating with a cavity, with a generally cylindrical sidewall and a bottom, formed therein; a jacket of a harder metal than the core surrounding at least the rear and front sections of the core, and extending at least partially into the cavity; and an expander of a rigid polymer disposed in the cavity, the expander substantially filling the cavity, and having at least one passage from its forward end to its rearward end.

2. The bullet according to claim 1 wherein the expander comprises a generally cylindrical body having a plurality of flutes formed in its surface, defining a plurality of splines between them, and forming a plurality of passages from the forward end to the rearward end of the expander.

3. The bullet according to claim 2 wherein the forward and rearward ends of the expander are higher in the center than adjacent the side.

4. The bullet according to claim 3 wherein the ends of the expander are pointed.

5. The bullet according to claim 3 wherein the ends of the expander are dome-shaped.

6. The bullet according to claim 1 wherein the passages in the expander comprise between about 20% and about 60% of the cross sectional area of the cavity.

7. The bullet according to claim 6 wherein the passages in the expander comprise between about 40% and about 60% of the cross sectional area of the cavity.

8. The bullet according to claim 1 wherein the cross-sectional area of each passage is less than about 0.004 $in^2$.

9. The bullet according to claim 8 wherein the cross sectional area of each passage is less than about 0.002 $in^2$.

10. The bullet according to claim 1 wherein the forward-most portion of the expander does not extend beyond the forward end of the bullet.

11. The bullet according to claim 1 wherein the center of mass of the bullet is rearward of the bottom of the cavity.

12. The bullet according to claim 1 wherein the core is lead or a lead alloy.

13. The bullet according to claim 1 wherein the jacket is copper or a copper alloy.

14. The bullet according to claim 1 wherein the jacket is bonded to the core.

15. The bullet according to claim 14 wherein the jacket is bonded to the core with knurling on the jacket, mechanically engaging the core.

* * * * *